US006829975B2

(12) United States Patent
Piras

(10) Patent No.: US 6,829,975 B2
(45) Date of Patent: Dec. 14, 2004

(54) HYDRAULIC PERCUSSION APPARATUS

(75) Inventor: Bernard Piras, Charly (FR)

(73) Assignee: Montabert S.A., Saint Priest (FR)

( * ) Notice: Subject to any disclaimer, the term of this patent is extended or adjusted under 35 U.S.C. 154(b) by 0 days.

(21) Appl. No.: 10/297,178

(22) PCT Filed: Jul. 10, 2001

(86) PCT No.: PCT/FR01/02227

§ 371 (c)(1),
(2), (4) Date: Jan. 13, 2003

(87) PCT Pub. No.: WO02/06013

PCT Pub. Date: Jan. 24, 2002

(65) Prior Publication Data

US 2003/0183402 A1 Oct. 2, 2003

(30) Foreign Application Priority Data

Jul. 13, 2000 (FR) ..... 00 09260

(51) Int. Cl.[7] ..... B25D 9/20
(52) U.S. Cl. ..... 91/303; 91/319; 91/321
(58) Field of Search ..... 91/218, 276, 281, 91/286, 303, 319, 321, 327

(56) References Cited

U.S. PATENT DOCUMENTS 4,635,531 A 1/1987 Rode ..... 91/303

FOREIGN PATENT DOCUMENTS

| | | | |
|---|---|---|---|
| FR | 2 045 289 A | | 2/1971 |
| FR | 2045289 | * | 2/1971 |
| FR | 2 369 908 A | | 6/1978 |
| WO | WO 93/22106 | | 11/1993 |

* cited by examiner

*Primary Examiner*—Thomas E. Lazo
(74) *Attorney, Agent, or Firm*—Oliff & Berridge, PLC

(57) ABSTRACT

A percussive hydraulic apparatus includes a body inside which is mounted a cylinder in which an impact piston is guided. Fluid distribution providing the motion of the piston is produced by a distributor housed in a distribution box mounted in the body. The cylinder and the distribution box are entirely contained in the enclosure defined by the body, with the cylinder being mechanically supported by one of its ends of the body. The distribution box is mounted coaxial to the cylinder and is mechanically supported thereon. Surfaces perpendicular to the axis of the apparatus, subjected to pressure, are arranged and dimensioned such that the resultant hydraulic forces applied on the cylinder and distribution box during all the phases of the operating cycle thereof are directed in the same direction towards a support located in the body of the apparatus.

19 Claims, 6 Drawing Sheets

HYDRAULIC PERCUSSION APPARATUS

The subject of the present invention is a percussive hydraulic apparatus.

A percussive hydraulic apparatus comprises a body inside which there is mounted a cylinder in which there is guided an impact piston driven back and forth by an incompressible fluid and which strikes a tool held at the lower end of the body. The distribution of the fluid which moves the piston is performed by a distributor housed in a distribution box mounted in the body.

Document EP 0 638 013 relates to a percussive apparatus in which the cylinder of the impact piston and the various liners forming the cylinder guiding the latter and the distributor are held in a body by a top cover, itself fixed to the body by screws. These screws mechanically immobilize the various parts, but give rise to the following disadvantages:

- the distribution of the pressure exerted by the cover is entirely dependent upon the clamping force transmitted by each screw. Now, tensioning short screws on a civil engineering works apparatus is generally performed by torquing, with all the uncertainties associated with this type of stressing: non-uniform friction in the threads of the screws, precision of the tightening equipment, etc. Deformation of the impact-piston guide assembly may therefore be caused by the tightening of the cover.
- the cover cannot simultaneously be in contact with the liners and the body of the apparatus as the functional clearance needed might then cause the cover to bend and this would result in bending on the screws, which is detrimental to their fatigue strength.
- a slight backing-off of the cover fixing screws results, through a relative movement of the liners with respect to one another, in wear of the bearing surfaces, and gradual misalignment which may detract from the hydraulic guidance of the impact piston.

The object of the invention is to provide a percussive hydraulic apparatus in which the various parts intended to be mounted in an enclosure of the body are not subjected to the constraints resulting from screw-tightening, with the ensuing disadvantages defined above.

To this end, the percussive hydraulic apparatus to which it relates comprising a body inside which there is mounted a cylinder in which there is guided an impact piston driven back and forth by an incompressible fluid and which strikes a tool held at the lower end of the body, the distribution of the fluid which moves the piston being performed by a distributor housed in a distribution box mounted in the body, is characterized in that the cylinder and the distribution box are entirely contained in the enclosure delimited by the body, in that the cylinder bears axially on the body, in that the distribution box is mounted coaxially with respect to the cylinder and bears mechanically thereon and in that the surfaces perpendicular to the axis of the apparatus, subjected to pressure, are arranged and dimensioned in such a way that the resultants of the hydraulic forces applied to the parts, cylinder and distribution box, are directed in the same direction toward a support situated in the body of the apparatus, throughout all the phases of the operating cycle thereof.

According to one embodiment, this apparatus also comprises a distribution cover arranged coaxially with respect to the distribution box and bearing axially thereon, of which the surfaces perpendicular to the axis of the apparatus and subjected to pressure are arranged and dimensioned in such a way that the resultant of the hydraulic forces applied to the cover is directed in the same direction as the resultant of the forces applied to the other parts, cylinder and distribution box, throughout all the phases of the operating cycle of the apparatus.

It is apparent from this structure that the parts which consist of the cylinder, the distribution box and the distribution cover are not fixed mechanically by the cover of the body, as they usually would be. The degree to which the cover is tightened down onto the body therefore has absolutely no influence on the integrity of the various parts inside the body, on the one hand, and relative to one another, on the other hand, because these parts are firmly pressed against one another and against the body by hydraulic forces. This results in the possibility of having far broader manufacturing tolerances than in the conventional case of assembly by screw-fastening, while at the same time enjoying better apparatus behavior since the risks of deformation of the cylinder and of misalignment of the guidance of the impact piston which are known from the prior art are avoided.

According to one feature of the invention, the support of the body, against which the various parts are hydraulically pushed, consists of the end wall of the enclosure, on the tool side, in which enclosure the cylinder is mounted.

According to another feature, each part, cylinder, distribution box, distribution cover, has two antagonist surfaces the first of which is subjected alternately to the high and to the low pressure and the second of which, of a larger surface area than the first, is constantly subjected to the high pressure.

According to one embodiment of this apparatus, the end face of the cylinder bearing against the end wall of the enclosure of the body is at atmospheric pressure while its opposite face is always subjected to the high pressure. The cylinder is thus firmly pressed into the end wall of the enclosure of the body.

According to one possibility, the distribution box has two successive cylindrical portions of which the one facing toward the piston is closed off by an end wall delimiting, with the piston, a chamber connected alternately to the high and to the low pressure, and of which the other portion, which has a larger cross section than the first, is situated in a chamber constantly supplied with high-pressure fluid.

Advantageously, the distribution cover has a circular wall the outer face of which bears against the interior face of the distribution box, the interior face of which serves, in part, to guide the distributor, the lower face of which delimits, in part, an annular chamber which is constantly connected to the low-pressure circuit, this circular wall ending in a part of larger cross section resting on the end of the distribution box and situated in a chamber constantly supplied with high-pressure fluid.

According to another embodiment, the distribution cover has a circular wall the outer face of which bears in a bore of the body, the lower face of which bears against the upper face of the distribution box, the interior face of which serves, in part, to guide the distributor and delimits therewith an annular chamber which is constantly connected to the low-pressure circuit, this circular wall ending, at its upper end, in a part of larger cross section situated in a chamber constantly supplied with high-pressure fluid.

In any case, the invention will be clearly understood from the description which follows, with reference to the appended schematic drawing which, by way of nonlimiting examples, depict several embodiments of this apparatus:

Figure 1:
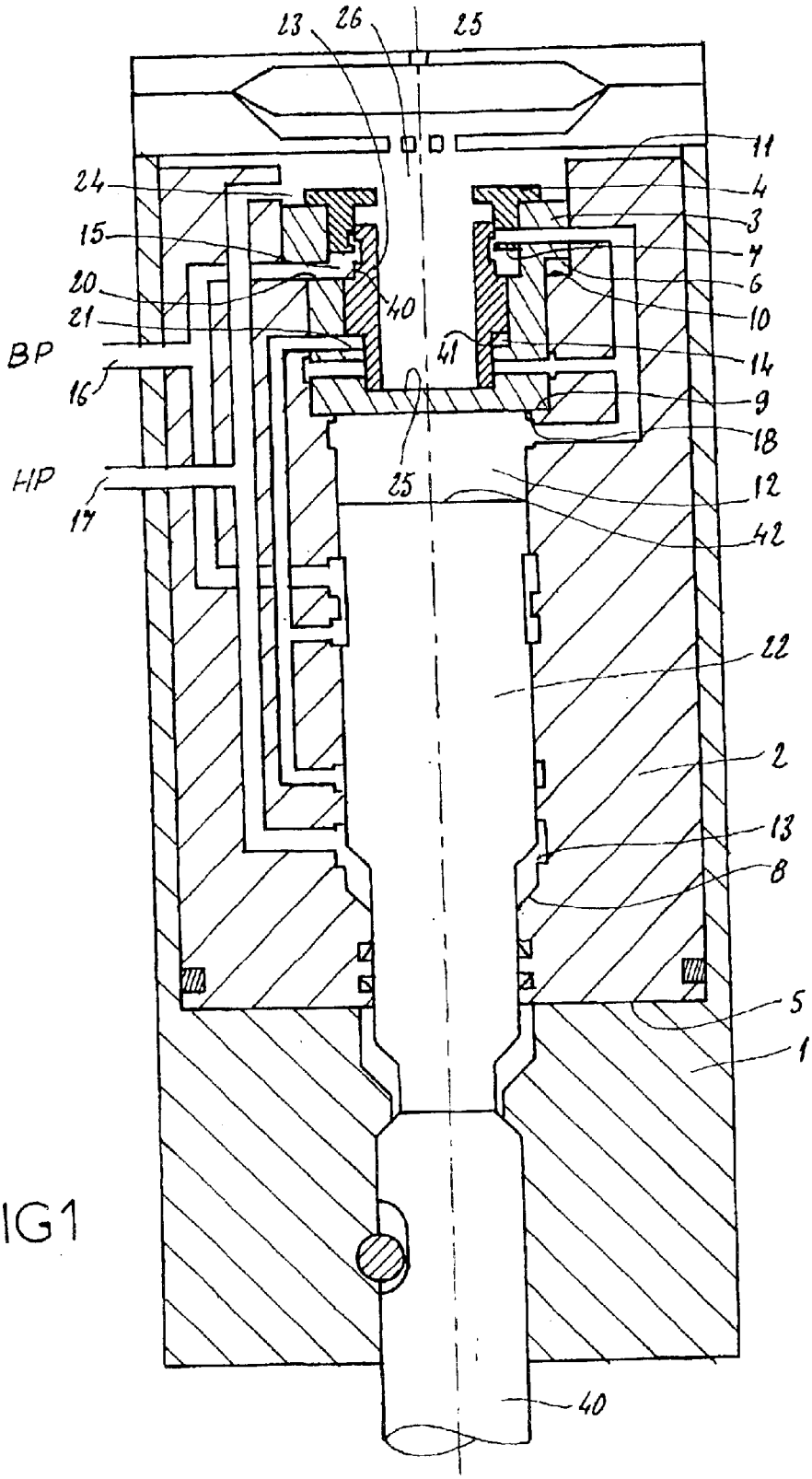
FIG. 1 is a view in longitudinal section of an apparatus equipped with a first cylinder-distribution means assembly.

The apparatus depicted in FIG. 1 comprises a body 1 in which there is formed axially a cavity serving to house a cylinder 2 which rests against the end wall 5 of the cavity situated on the same side as an impact tool 40. The cylinder 2 serves to guide back and forth an impact piston 22 which is intended, during each operating cycle, to strike the head of the tool 40. Mounted in a central and axial cavity in the upper part of the cylinder 2 is a distribution box 3 in the upper end of which is mounted a distribution cover 4. Mounted inside the distribution box is a distributor 23 which acts on the supply of incompressible fluid to the apparatus to cause the piston to move back and forth.

The impact piston 22 delimits, with its cylinder, two antagonist chambers, a lower annular chamber 13 always subjected to the high pressure HP from the duct 17 and an upper chamber 12 is alternately subjected to the high and to the low pressure by the distributor 23 so that the resultant of the pressures exerted on the impact piston is in one direction then the other in turn.

The distribution box delimits with the cylinder an annular chamber 6 which is always subjected to the low pressure via the duct 16.

The distributor 23 delimits with the distribution box 3 an annular chamber 14 known as the command chamber which is alternately in communication with the high (HP) and the low (BP) pressure depending on the position of the impact piston 22.

The distributor 23, the distribution box 3, the distribution cover 4 delimit an annular chamber 15 always subjected to the low pressure via the duct 16.

Maintaining the equilibrium of the distribution cover 4 is simple in that the surface 7 delimiting the chamber 15 is systematically at the pressure BP, and in that the pressure HP in the chamber 26 is exerted on the surface opposite the chamber 26, thus hydraulically keeping the cover 4 pushed downward. The cover therefore exerts a force on the distribution box $F_{cov}=(HP-BP)(S_7)$ when the distributor is in the low position, and $F_{cov}=(HP-BP)(S_7)-(HP-BP)(S_{40})$ when the distributor is in the raised position. $[HP-BP](S_{40})$ representing the force exerted by the distributor.

If the equilibrium of the distribution box 3 is considered, this box is subjected to the high pressure on its surface 24 (area $S_{24}$), the surface 6 (area $S_6$) delimited by the distribution box 3 and the cylinder 2 is always subjected to the pressure BP, the surface 20 (area $S_{20}$) delimited by the chamber 15 is always subjected to the pressure BP, the surface 21 (area $S_{21}$) delimited by the annular chamber 14 is subjected alternately to HP and to BP, the surface 25 (area $S_{25}$) is always subjected to the pressure HP, the surface 18 (area $S_{18}$) forming the end wall of the box and delimited by the upper chamber 12 and the body 2 is subjected alternately to HP and BP.

As a result, there are four different possible states of equilibrium for the distribution box 3.

As the piston rises, when the distributor is in the low position:

$$S_{24}+S_{20}+S_{21}+S_{25}=S_{18}+S_6$$

The resultant $F_B$ of the forces applied to the distribution box can be written:

$$F_B=(S_{24}\times HP)+(S_{20}\times BP)+(S_{21}\times BP)+(S_{26}\times HP)-(S_{18}\times BP)-(S_6\times BP)+F_{cov}+F_{DIST}=HP$$

$$(S_{24}+S_{25})+BP(S_{20}+S_{21}-S_{18}-S_6)+(HP-BP)(S_7)+(HP-BP)(S_{41}-S_{40})$$

with $F_{cov}$=force exerted by the cover on the box $F_{DIST}$=force exerted by the distributor on the box now, from the first equation:

$$S_{20}+S_{21}-S_{18}-S_6=-S_{24}-S_{25}$$

hence:

$$F_B=(HP-BP)(S_{24}+S_{25}+S_7+S_{41}-S_{40})=(HP-BP)S_t$$

with $S_t$ being the projected surface area of the view from above of the box.

The distribution box is thus kept hydraulically pushed downward by the resultant of the applied forces.

Likewise, as the piston rises, when the distributor is in the raised position, the cross section 21 is then subjected to the pressure HP.

$$\begin{aligned} F_B &= (S_{24}\times HP)+(S_{20}\times BP)+(S_{21}\times HP)+(S_{25}\times HP)- \\ &\quad (S_{18}\times BP)-(S_6\times BP)+F_{cov} \\ &= HP(S_{24}+S_{21}+S_{25})+BP(S_{20}-S_{18}-S_6)+ \\ &\quad (HP-BP)(S_7)-(HP-BP)(S_{40}) \end{aligned}$$

now $$S_{20}-S_{18}-S_6=-S_{24}-S_{21}-S_{25}$$

hence:

$$F_B=(HP-BP)(S_{24}+S_{21}+S_{25}+S_7-S_{40})=(HP-BP)S_t$$

As the piston descends, when the distributor is in the raised position, the chambers 14 and 12 are then subjected to the pressure HP $$\begin{aligned} F_B &= (S_{24}\times HP)+(S_{20}\times BP)+(S_{21}\times HP)+(S_{25}\times HP)- \\ &\quad (S_{18}\times HP)-(S_6\times BP)+F_{cov} \\ &= HP(S_{24}+S_{21}+S_{25}-S_{18})+BP(S_{20}-S_6)+ \\ &\quad (HP-BP)(S_7)-(HP-BP)(S_{40}) \end{aligned}$$

now $$S_{20}-S_6=-S_{24}-S_{21}-S_{25}+S_{18}$$

hence:

$$F_B=(HP-BP)(S_{24}+S_{21}+S_{25}-S_{18}+S_7-S_{40})$$

now $$S_7-S_{40}=S_{20} \text{ and } S_6=S_{24}+S_{20}+S_{21}+S_{25}-S_{18}$$

$$F_B=(HP-BP)(S_6)$$

The distribution box is constantly kept hydraulically pushed downward by the resultant of the applied forces.

As the piston descends, when the distributor is in the lowered position, the command chamber 14 is once again at BP and the chamber 12 is still at HP.

$$F_B = (S_{24} \times HP) + (S_{20} \times BP)(S_{21} \times BP) + (S_{25} \times HP) - (S_{18} \times HP) - (S_6 \times BP) + F_{cov} + F_{DIST}$$
$$= HP(S_{24} + S_{25} - S_{18}) + BP(S_{20} + S_{21} - S_6) + (HP - BP)(S_7) + (HP - BP)(S_{41} - S_{40})$$

now $$S_{20}+S_{21}-S_6=-S_{24}-S_{25}+S_{18}$$

hence:

$$F_B=(HP-BP)(S_{24}+S_{25}-S_{18}+S_7+S_{41}-S_{40})$$

now $$S_7+S_{41}-S_{40}=S_{20}+S_{21}$$

$$F_B=(HP-BP)(S_6)$$

In all the phases of operation, the distribution box is therefore constantly kept hydraulically pushed toward the cylinder.

If we consider the equilibrium of the cylinder 2, the latter is subjected to atmospheric pressure Pa on its entire lower surface 5 (area $S_5$), the annular surface 8 (known as area $S_8$ in projection onto a surface parallel to the surface 5) is always subjected to the pressure HP, the surface 9 (area $S_9$) is subjected to the pressure of the chamber 12 (HP as the piston descends, BP as the piston rises), the surface 10 (area $S_{10}$) is always subjected to the pressure BP, the surface 11 (area $S_{11}$) is always subjected to the pressure HP. If the various forces applied to the cylinder are denoted $F_5$, $F_8$, $F_9$, $F_{10}$ and $F_{11}$ respectively, with:

as the piston rises:

$F_5=S_5\times P_a$ $F_8=S_8\times HP$ $F_9=S_9\times BP$ $F_{10}=S_{10}\times BP$ $F_{11}=S_{11}\times HP$ $F_B$=force applied by the box to the cylinder and $S_5=S_8+S_9+S_{10}+S_{11}$ then the resultant $F_c$ of the forces applied to the cylinder can be written:

$$F_c = F_5 + F_8 + F_9 + F_{10} + S_{11} + F_B$$
$$= -(S_5 \times P_a) + (S_8 \times HP) + (S_9 \times BP) + (S_{10} \times BP) + (S_{11} \times HP) + F_B$$

$$F_c=(S_5\times P_a)+HP\times(S_8+S_{11})+BP(S_9+S_{10})+F_B$$

As atmospheric pressure is negligible with respect to the pressure HP, this yields:

$$F_c=HP(S_8+S_{11})+BP(S_9+S_{10})+(HP-BP)S_t$$

now $S_t=S_{10}+S_9+S_{42}$ ($S_t$: projected surface area of the view from beneath of the box)

$$F_c=HP(S_{11}+S_{10}+S_9+S_{42})+HP\times S_8-BP\times S_{12}$$

under dynamic conditions.

If the calculation is performed for static conditions, the forces on the piston are almost an equilibrium and $HP\times S_8=BP\times S_{42}$, hence $$F_c=HP(S_{11}+S_{10}+S_9+S_{42})$$

The cylinder is therefore kept hydraulically pushed downward by the pressure HP.

as the piston descends:

$$F_5,\ F_8,\ F_{10},\ F_{11} \text{ remain unchanged, } F_9=S_9\times HP$$

In this case, $$F_c\approx HP(S_8+S_{11}+S_9)+BP(S_{10})+F_B$$

The cylinder is therefore kept, still hydraulically, pushed toward the bottom of the body 1 by the resultant of the applied forces.

FIGS. 2, 3, 4 and 5 depict alternative forms of embodiment of the apparatus of FIG. 1, in which the capacity of the upper chamber that drives the impact piston 22 has been reduced by the addition of an additional chamber which may, as appropriate, be connected to atmospheric pressure or to the pressure of the low-pressure return circuit so that its action on the resultant of the forces applied to the piston is negligible. A driving chamber with a small volume makes it possible to obtain high frequencies while at the same time maintaining the same input flow rate, the overall power being maintained by increasing the working pressure.

In these figures, the same elements are denoted by the same references as in FIG. 1.

Figure 2:
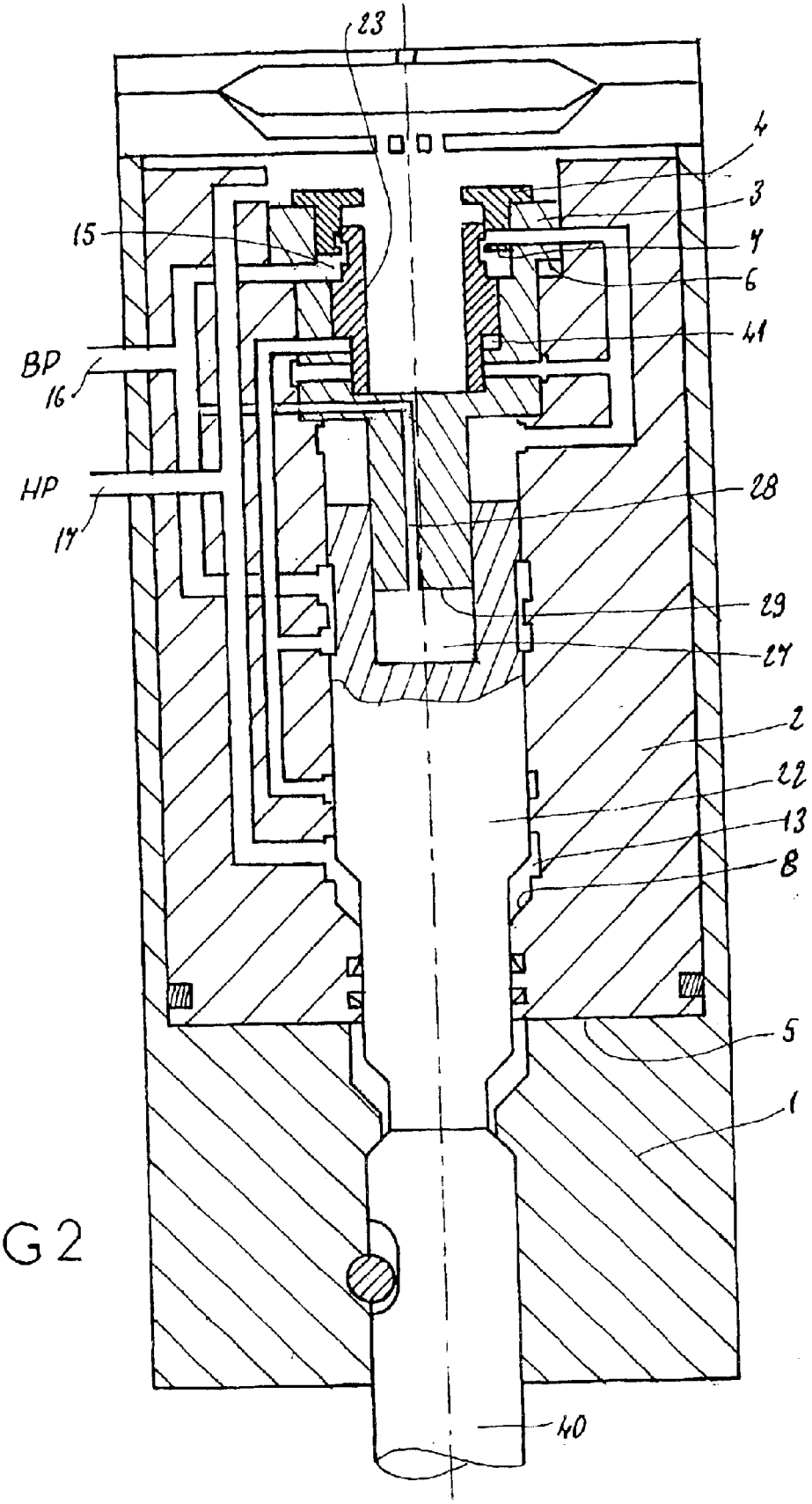
FIGS. 2 to 6 are views in longitudinal section of five alternative forms of embodiment of the apparatus of FIG. 1.

In the embodiment depicted in FIG. 2, a chamber 27 delimited by the impact piston and the distribution box has been added. This chamber 27 is constantly connected to the return circuit and therefore to the low pressure by the duct 28.

The equilibrium of the distribution cover 4 remains unchanged by comparison with FIG. 1.

The equilibrium of the distribution box on the other hand is modified because the chamber 27 delimits a surface 29 which reduces the effect of the surface 18 in FIG. 1. As this surface 29 is always subjected to the low pressure, the distribution box will experience a downward resultant of forces which is of even greater magnitude than it was in FIG. 1. Equilibrium of the cylinder 2 with respect to FIG. 1 follows the change in force $F_B$.

Figure 3:
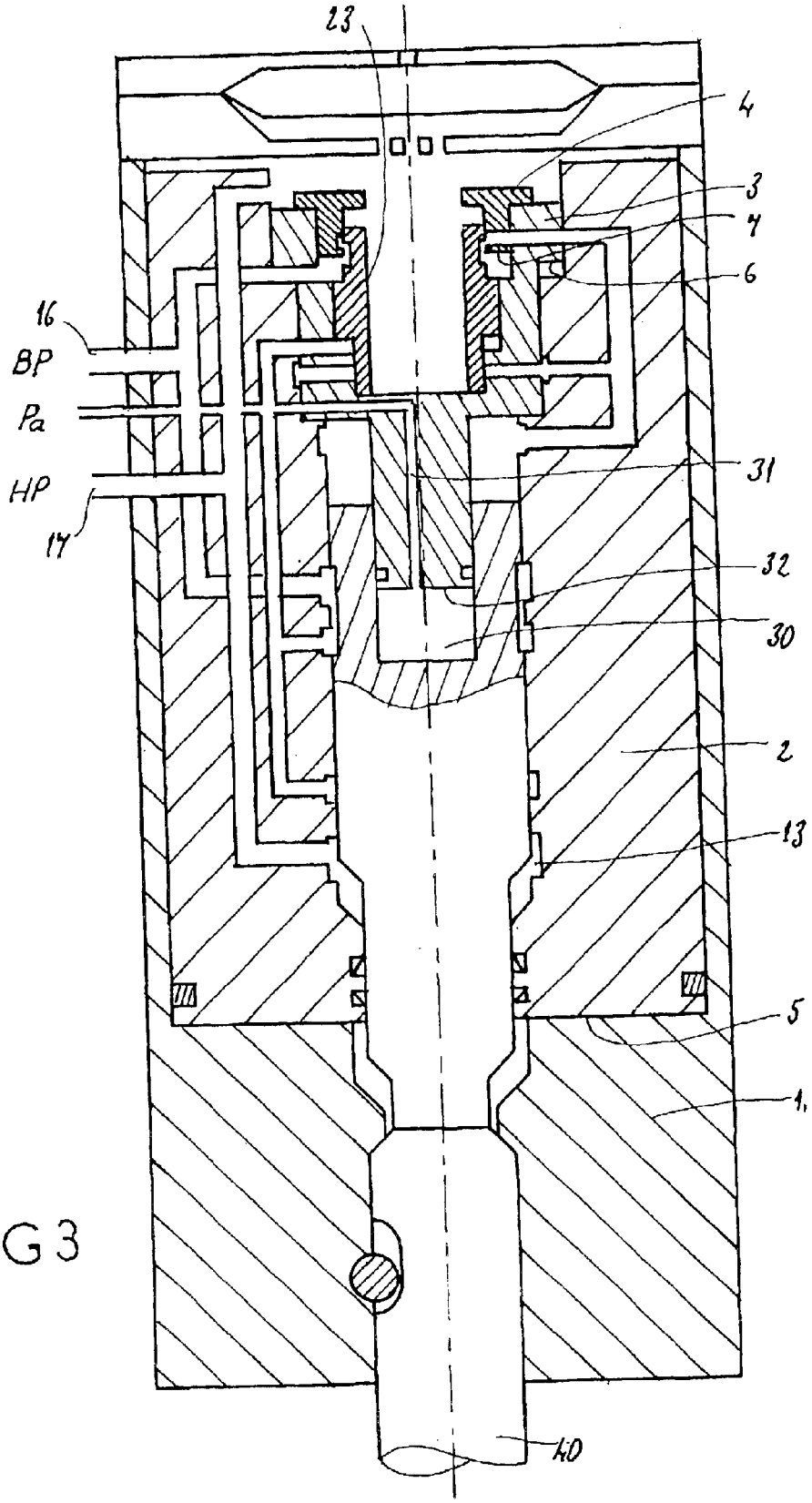

FIG. 3 depicts an alternative form of embodiment of the apparatus of FIG. 2, in which the chamber 27 is replaced by a chamber 30 delimiting a surface 32 of the distribution box which is always subjected to atmospheric pressure.

Figure 4:
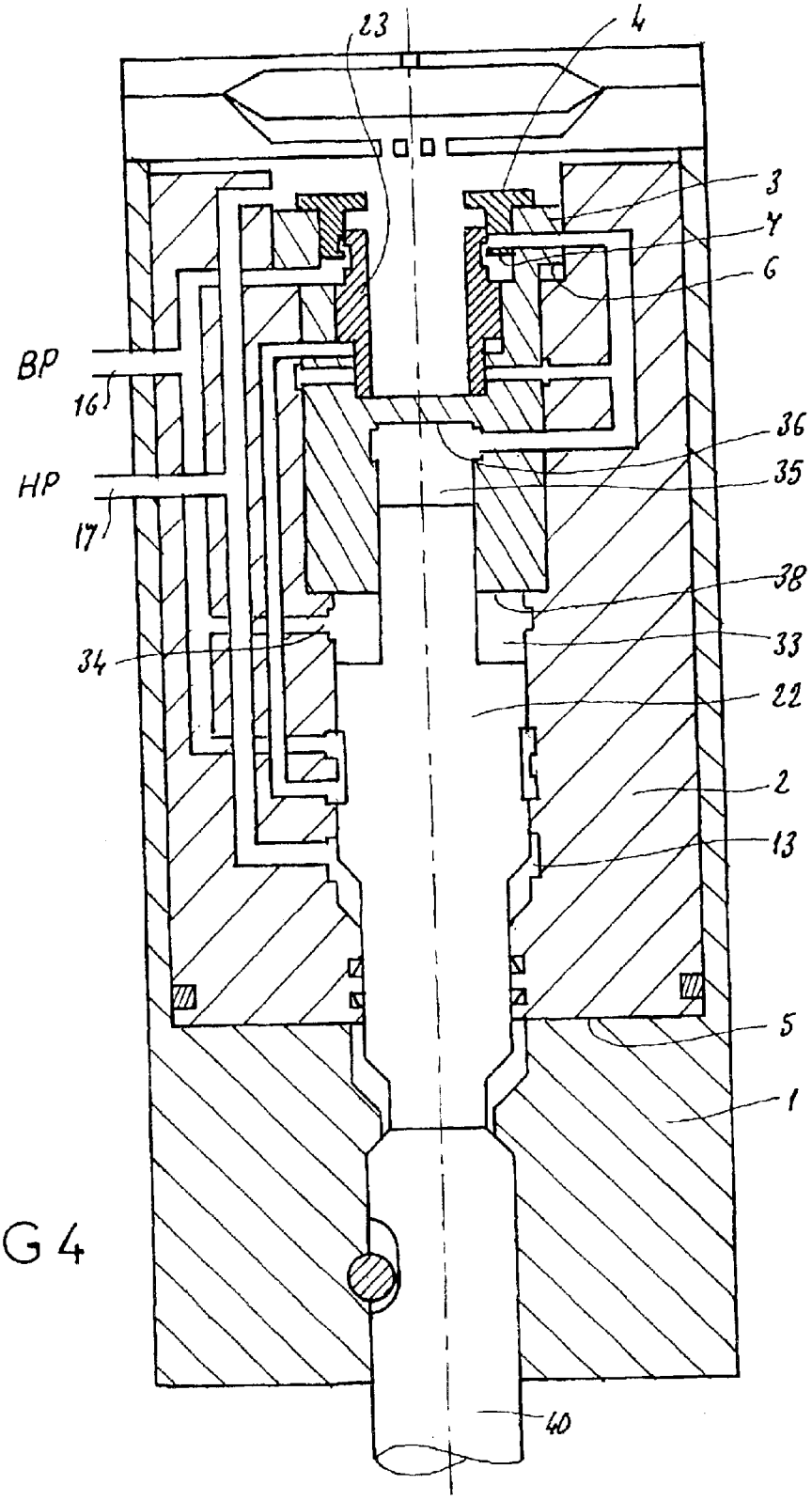

In the embodiment depicted in FIG. 4, unlike FIGS. 2 and 3, the driving upper chamber 35 is no longer annular and delimits a surface 36 of the distribution box 3, while an annular chamber 33 is created and delimited by the impact piston 22, the cylinder 1 and the distribution box 3. The chamber 33 is constantly connected to the low-pressure return circuit by the duct 34, and the surface 38 it delimits has the function of increasing the resultant of the forces which presses the distribution box firmly downward without in any way altering the equilibrium of the cylinder 2 and of the cover 4.

Figure 5:
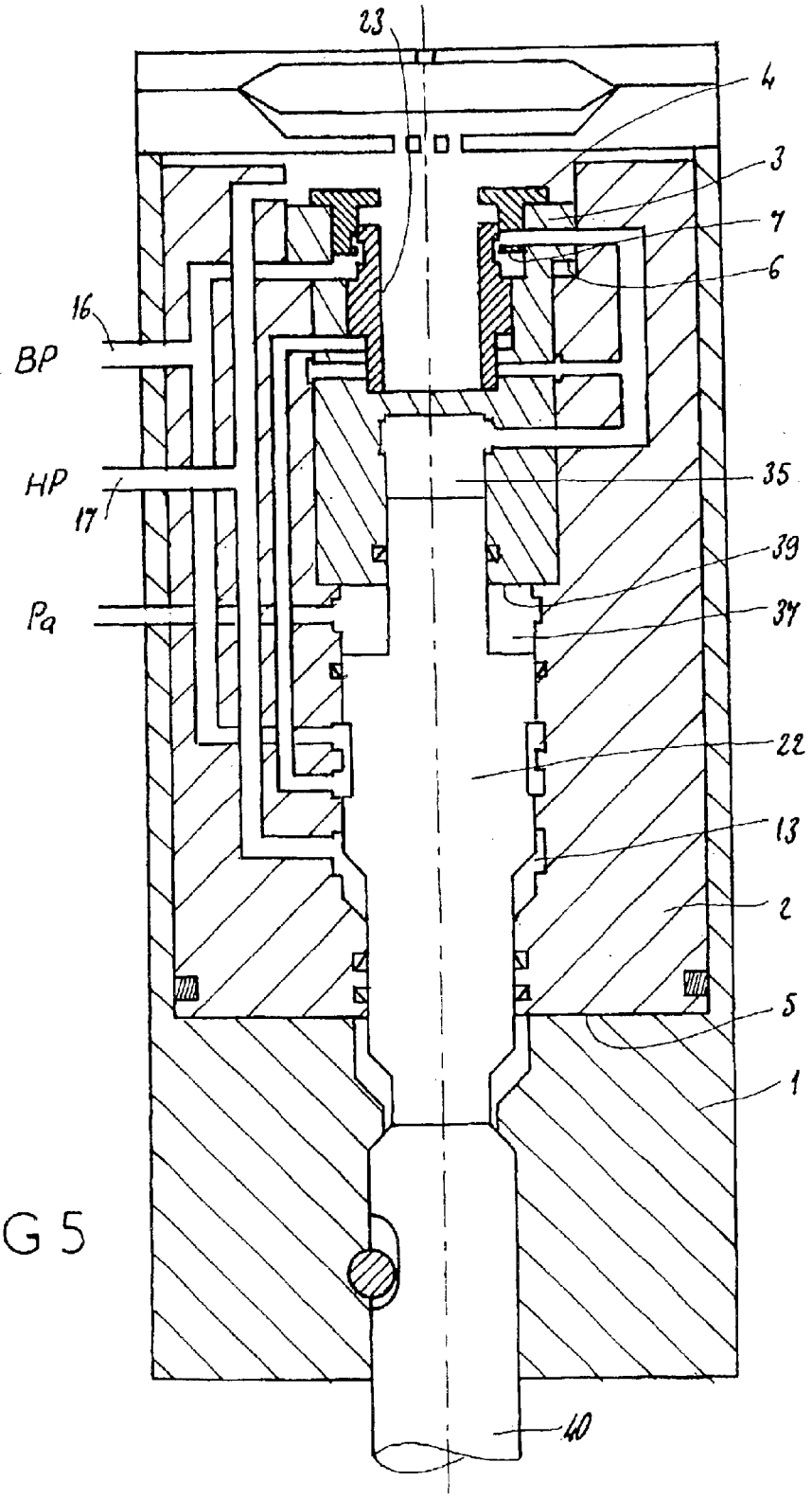

FIG. 5 depicts an alternative form of embodiment of the apparatus of FIG. 4, in which the chamber 33 is replaced by a chamber 37 delimiting a surface 39 of the distribution box that is always subjected to atmospheric pressure.

Figure 6:
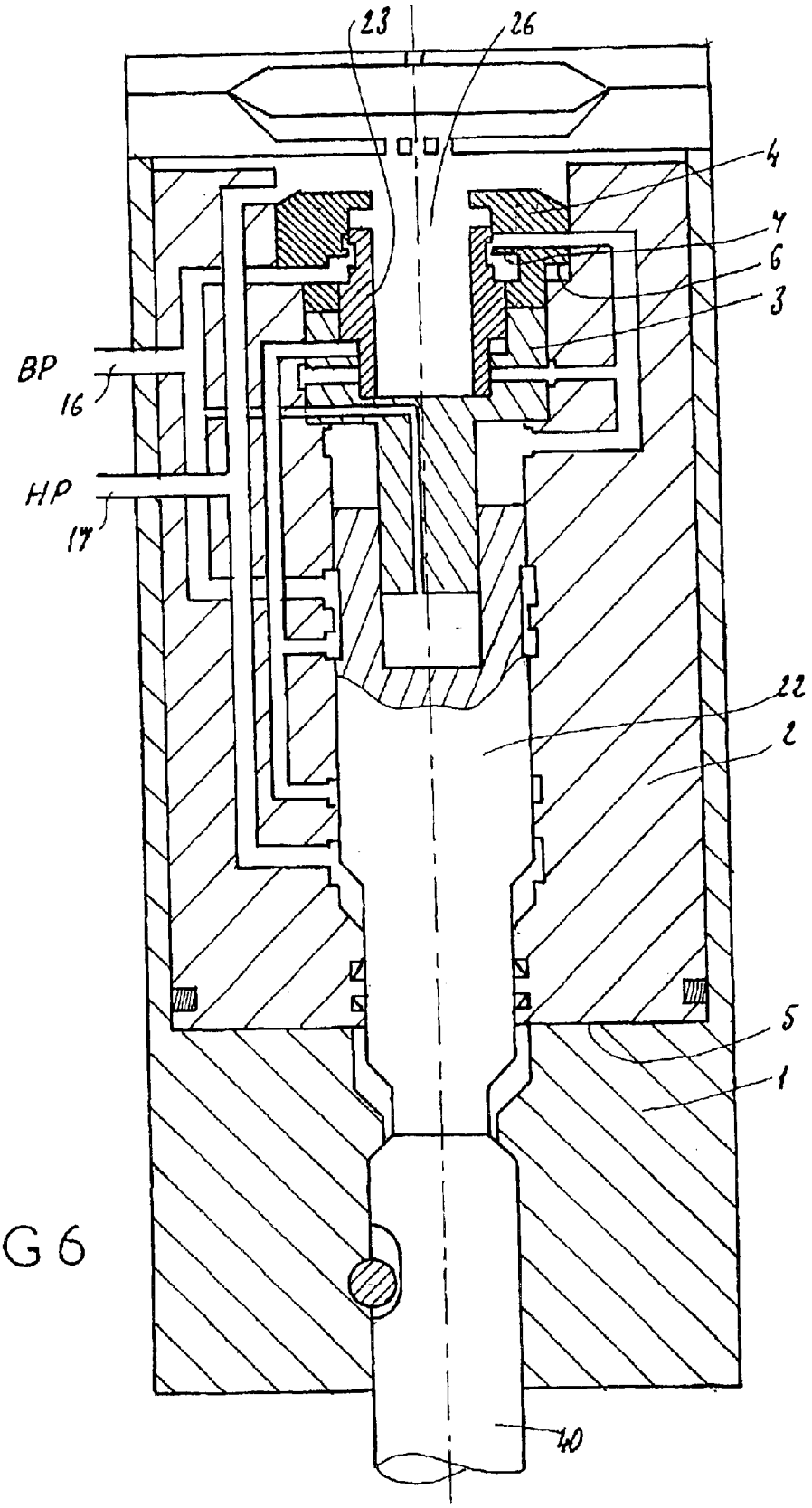

FIG. 6 depicts an alternative form of embodiment that can apply to the apparatuses of FIGS. 2, 3, 4 and 5, and in which the distribution cover 4 is this time guided directly in the cylinder 2 rather than the distribution box 3.

As before, the various surfaces of the distribution cover and of the distribution box are arranged in such a way that the resultants of the forces applied to them are always directed downward.

What is claimed is:

1. A percussive hydraulic apparatus comprising a body inside which there is mounted a cylinder in which there is guided an impact piston driven back and forth by an incompressible fluid and which strikes a tool held at the lower end of the body, the distribution of the fluid which moves the piston being performed by a distributor housed in a distribution box mounted in the body, characterized in that the cylinder and the distribution box are entirely contained in the enclosure delimited by the body, in that the cylinder bears axially on the body, in that the distribution box is mounted coaxially with respect to the cylinder and bears mechanically thereon and in that the surfaces perpendicular to the axis of the apparatus, subjected to pressure, are arranged and dimensioned in such a way that the resultant of the hydraulic forces applied to the cylinder and distribution box is directed in the same direction toward a support situated in the body of the apparatus, throughout all the phases of the operating cycle thereof.

2. The percussive hydraulic apparatus as claimed in claim 1, further comprising a distribution cover arranged coaxially with respect to the distribution box and bearing axially thereon, of which the surfaces perpendicular to the axis of the apparatus and subjected to pressure are arranged and dimensioned in such a way that the resultant of the hydraulic forces applied to the cover is directed in the same direction as the resultant of the hydraulic forces applied to the cylinder and distribution box, throughout all the phases of the operating cycle of the apparatus.

3. The percussive hydraulic apparatus as claimed in claim 2, characterized in that the distribution cover has a circular wall the outer face of which bears against the interior face of the distribution box, the interior face of which serves, in part, to guide the distributor, the lower face of which delimits, in part, an annular chamber which is constantly connected to the low-pressure circuit, this circular wall ending in a part of larger cross section resting on the end of the distribution box and situated in a chamber constantly supplied with high-pressure fluid.

4. The percussive hydraulic apparatus as claimed in claim 2, characterized in that the distribution cover has a circular wall the outer face of which bears in a bore of the body, the lower face of which bears against the upper face of the distribution box, the interior face of which serves, in part, to guide the distributor and delimits therewith an annular chamber which is constantly connected to the low-pressure circuit, this circular wall ending, at its upper end, in a part of larger cross section situated in a chamber constantly supplied with high-pressure fluid.

5. The percussive hydraulic apparatus as claimed in claim 2, characterized in that the support of the body, against which the cylinder and distribution box are hydraulically pushed, consists of the end wall of the enclosure, on the tool side, in which enclosure the cylinder is mounted.

6. The percussive hydraulic apparatus as claimed in claim 2, characterized in that the cylinder, distribution box, and distribution cover, each have at least two antagonist surfaces one of which is subjected alternately to the high and to the low pressure and the other of which, of a larger surface area than the first, is constantly subjected to the high pressure.

7. The percussive hydraulic apparatus as claimed in claim 1, characterized in that the support of the body, against which the cylinder and distribution box are hydraulically pushed, consists of the end wall of the enclosure, on the tool side, in which enclosure the cylinder is mounted.

8. The percussive hydraulic apparatus as claimed in claim 7, characterized in that the end face of the cylinder bearing against the end wall of the enclosure of the body is at atmospheric pressure while its opposite face is always subjected to the high pressure.

9. The percussive hydraulic apparatus as claimed in claim 8, further comprising a distribution cover arranged coaxially with respect to the distribution box and bearing axially thereon, of which the surfaces perpendicular to the axis of the apparatus and subjected to pressure are arranged and dimensioned in such a way that the resultant of the hydraulic forces applied to the cover is directed in the same direction as the resultant of the hydraulic forces applied to the cylinder and distribution box, throughout all the phases of the operation cycle of the apparatus, characterized in that the distribution cover has a circular wall the outer face of which bears against the interior face of the distribution box, the interior face of which serves, in part, to guide the distributor, the lower face of which delimits, in part, an annular chamber which is constantly connected to the low-pressure circuit, this circular wall ending in a part of larger cross section resting on the end of the distribution box and situated in a chamber constantly supplied with high-pressure fluid.

10. The percussive hydraulic apparatus as claimed in claim 8, further comprising a distribution cover arranged coaxially with respect to the distribution box and bearing axially thereon, of which the surfaces perpendicular to the axis of the apparatus and subjected to pressure are arranged and dimensioned in such a way that the resultant of the hydraulic forces applied to the cover is directed in the same direction as the resultant of the hydraulic forces applied to the cylinder and distribution box, throughout all the phases of the operating cycle of the apparatus, characterized in that the distribution cover has a circular wall the outer face of which bears in a bore of the body, the lower face of which bears against the upper face of the distribution box, the interior face of which serves, in part, to guide the distributor and delimits therewith an annular chamber which is constantly connected to the low-pressure circuit, this circular wall ending, at its upper end, in a part of larger cross section situated in a chamber constantly supplied with high-pressure fluid.

11. The percussive hydraulic apparatus as claimed in claim 7, characterized in that the cylinder and distribution box each have at least two antagonist surfaces one of which is subjected alternately to the high and to the low pressure and the other of which, of a larger surface area than the first, is constantly subjected to the high pressure.

12. The percussive hydraulic apparatus as claimed in claim 7, further comprising a distribution cover arranged coaxially with respect to the distribution box and bearing axially thereon, of which the surfaces perpendicular to the axis of the apparatus and subjected to pressure are arranged and dimensioned in such a way that the resultant of the hydraulic forces applied to the cover is directed in the same direction as the resultant of the hydraulic forces applied to the cylinder and distribution box, throughout all the phases of the operating cycle of the apparatus, characterized in that the distribution cover has a circular wall the outer face of which bears against the interior face of the distribution box, the interior face of which serves, in part, to guide the distributor, the lower face of which delimits, in part, an annular chamber which is constantly connected to the low-pressure circuit, this circular wall ending in a part of larger cross section resting on the end of the distribution box and situated in a chamber constantly supplied with high-pressure fluid.

13. The percussive hydraulic apparatus as claimed in claim 7, further comprising a distribution cover arranged coaxially with respect to the distribution box and bearing axially thereon, of which the surfaces perpendicular to the axis of the apparatus and subjected to pressure are arranged and dimensioned in such a way that the resultant of the hydraulic forces applied to the cover is directed in the same direction as the resultant of the hydraulic forces applied to the cylinder and distribution box, throughout all the phases of the operation cycle of the apparatus, characterized in that the distribution cover has a circular wall the outer face of which bears in a bore of the body, the lower face of which bears against the upper face of the distribution box, the interior face of which serves, in part, to guide the distributor and delimits therewith an annular chamber which is constantly connected to the low-pressure circuit, this circular wall ending, at its upper end, in a part of larger cross section situated in a chamber constantly supplied with high-pressure fluid.

14. The percussive hydraulic apparatus as claimed in claim 1, characterized in that the cylinder and distribution box each have at least two antagonist surfaces one of which is subjected alternately to the high and to the low pressure and the other of which, of a larger surface area than the first, is constantly subjected to the high pressure.

15. The percussive hydraulic apparatus as claimed in claim 14, characterized in that the distribution box has two successive cylindrical portions of which the one facing toward the piston is closed off by an end wall delimiting, with the piston, a chamber connected alternately to the high and to the low pressure, and of which the other portion, which has a larger cross section that the first, is situated in a chamber constantly supplied with high-pressure fluid.

16. The percussive hydraulic apparatus as claimed in claim 15, further comprising a distribution cover arranged coaxially with respect to the distribution box and bearing axially thereon, of which the surfaces perpendicular to the axis of the apparatus and subjected to pressure are arranged and dimensioned in such a way that the resultant of the hydraulic forces applied to the cover is directed in the same direction as the resultant of the hydraulic forces applied to the cylinder and distribution box, throughout all the phases of the operating cycle of the apparatus, characterized in that the distribution cover has a circular wall the outer face of which bears against the interior face of the distribution box, the interior face of which serves, in part, to guide the distributor, the lower face of which delimits, in part, an annular chamber which is constantly connected to the low-pressure circuit, this circular wall ending in a part of larger cross section resting on the end of the distribution box and situated in a chamber constantly supplied with high-pressure fluid.

17. The percussive hydraulic apparatus as claimed in claim 15, further comprising a distribution cover arranged coaxially with respect to the distribution box and bearing axially thereon, of which the surfaces perpendicular to the axis of the apparatus and subjected to pressure are arranged and dimensioned in such a way that the resultant of the hydraulic forces applied to the cover is directed in the same direction as the resultant of the hydraulic forces applied to the cylinder and distribution box, throughout all the phases of the operating cycle of the apparatus, characterized in that the distribution cover has a circular wall the outer face of which bears in a bore of the body, the lower face of which bears against the upper face of the distribution box, the interior face of which serves, in part, to guide the distributor and delimits therewith an annular chamber which is constantly connected to the low-pressure circuit, this circular wall ending, at its upper end, in a part of larger cross section situated in a chamber constantly supplied with high-pressure fluid.

18. The percussive hydraulic apparatus as claimed in claim 14, further comprising a distribution cover arranged coaxially with respect to the distribution box and bearing axially thereon, of which the surfaces perpendicular to the axis of the apparatus and subjected to pressure are arranged and dimensioned in such a way that the resultant of the hydraulic forces applied to the cover is directed in the same direction as the resultant of the hydraulic forces applied to the cylinder and distribution box, throughout all the phases of the operating cycle of the apparatus, characterized in that the distribution cover has a circular wall the outer face of which bears against the interior face of the distribution box, the interior face of which serves, in part, to guide the distributor, the lower face of which delimits, in part, an annular chamber which is constantly connected to the low-pressure circuit, this circular wall ending in a part of larger cross section resting on the end of the distribution box and situated in a chamber constantly supplied with high-pressure fluid.

19. The percussive hydraulic apparatus as claimed in claim 14, further comprising a distribution cover arranged coaxially with respect to the distribution box and bearing axially thereon, of which the surfaces perpendicular to the axis of the apparatus and subjected to pressure are arranged and dimensioned in such a way that the resultant of the hydraulic forces applied to the cover is directed in the same direction as the resultant of the hydraulic forces applied to the cylinder and distribution box, throughout all the phases of the operating cycle of the apparatus, characterized in that the distribution cover has a circular wall the outer face of which bears in a bore of the body, the lower face of which bears against the upper face of the distribution box, the interior face of which serves, in part, to guide the distributor and delimits therewith an annular chamber which is constantly connected to the low-pressure circuit, this circular wall ending, at its upper end, in a part of larger cross section situated in a chamber constantly supplied with high-pressure fluid.

* * * * *